US008608867B2

(12) United States Patent
Spühler

(10) Patent No.: US 8,608,867 B2
(45) Date of Patent: Dec. 17, 2013

(54) INDIVIDUALIZED JEWELERY ALLOYS AND METHOD FOR THEIR PRODUCTION

(76) Inventor: Markus Spühler, Zürich (CH)

( * ) Notice: Subject to any disclaimer, the term of this patent is extended or adjusted under 35 U.S.C. 154(b) by 965 days.

(21) Appl. No.: 12/519,138

(22) PCT Filed: Dec. 3, 2007

(86) PCT No.: PCT/CH2007/000606

§ 371 (c)(1),
(2), (4) Date: Nov. 17, 2009

(87) PCT Pub. No.: WO2008/071020

PCT Pub. Date: Jun. 19, 2008

(65) Prior Publication Data

US 2010/0074830 A1 Mar. 25, 2010

(30) Foreign Application Priority Data

Dec. 15, 2006 (CH) ..... 2056/06

(51) Int. Cl.
*C22C 5/00* (2006.01)

(52) U.S. Cl.
USPC ..... 148/207; 148/316; 423/439; 423/414; 164/97

(58) Field of Classification Search
USPC ..... 148/316, 207
See application file for complete search history.

(56) References Cited

U.S. PATENT DOCUMENTS

| | | | | |
|---|---|---|---|---|
| 1,640,680 | A * | 8/1927 | Vanderlaan | 428/542.2 |
| 3,297,405 | A | 1/1967 | Sperk et al. | |
| 4,820,487 | A | 4/1989 | Antoniazzi | |
| 6,382,111 | B1 | 5/2002 | Hojaji | |
| 7,210,203 | B1 * | 5/2007 | Wimprine, Jr. | 27/1 |
| 7,228,602 | B2 * | 6/2007 | Weisbrot et al. | 27/1 |
| 2002/0025392 | A1 | 2/2002 | Yardley et al. | |
| 2004/0031434 | A1 * | 2/2004 | VandenBiesen et al. | 117/1 |
| 2006/0239895 | A1 * | 10/2006 | Hasebe et al. | 423/446 |
| 2007/0000351 | A1 | 1/2007 | Brennan | |

FOREIGN PATENT DOCUMENTS

| | | | |
|---|---|---|---|
| EP | 1717340 | A2 | 11/2006 |
| GB | 1089534 | | 7/2002 |
| JP | 60218450 | A | 11/1985 |
| JP | 2002185932 | | 7/1990 |
| JP | 2008020830 | | 1/1996 |
| JP | 2002085116 | A | 3/2002 |
| JP | 2005298832 | A * | 10/2005 |
| WO | 03008084 | A1 | 1/2003 |
| WO | 2006082259 | A1 | 8/2005 |

OTHER PUBLICATIONS

Landrin, A Treatise on Steel, Philadelphia, Henry Carey Baird, 1868.*

* cited by examiner

*Primary Examiner* — Roy King
*Assistant Examiner* — Christopher Kessler
(74) *Attorney, Agent, or Firm* — Janet Sleath; Speckman Law Group PLLC

(57) ABSTRACT

A method for the individualization of a metallic material by means of a carbon-containing basic material of organic origin is proposed. The novel method makes it possible to produce individualized ornamental alloys and individualized symbolic articles, such as pieces of jewelry, in a first step a carbon-containing organic basic material, which originates from at least one specific clearly identifiable person or a clearly identifiable group of persons, being converted into a carbonized initial material, and, in a second step, a physical and chemical incorporation of at least a fraction of the carbonized initial material into the metallic material taking place. The novel method and the novel ornamental alloys make it possible to produce symbolic articles with a direct material or substantive relation to a desired person by simple means, without creative freedom being restricted.

20 Claims, No Drawings

INDIVIDUALIZED JEWELERY ALLOYS AND METHOD FOR THEIR PRODUCTION

REFERENCE TO RELATED APPLICATIONS

This application is the US national phase entry of International Patent Application No. PCT/CH2007/000606, filed Dec. 3, 2007, which claims priority to Swiss Patent Application No. CH 2056/06, filed Dec. 15, 2006.

FIELD OF INVENTION

The present invention relates to a method for the individualization of metallic materials, by means of a carbon-containing basic material of organic origin, and to individualized ornamental alloys.

BACKGROUND OF THE INVENTION

The individualization or personalization of symbolic articles, such as pieces of jewelry, and decorative articles and mementos, accords with a basic human need. Many people want to stand out from the mass by possessing an individual unique and personal decorative item or to express the importance of a relation or bond with another person or living thing. A first step toward a personalized decorative item is the mechanical machining, customary for a long time, of a standard decorative item, for example by means of engraving. In this case, for example, the names of the marriage partners and the wedding date are engraved into wedding rings. However, the reference to the married person remains purely ideal and, de facto, immaterial. The decorative items produced in this way therefore lack the direct material or substantive relation to the desired person.

Even thousands of years ago, this need led in many cultures to the development of decorative items in which, for example, a lock of hair of a certain person was kept in a suitable reception space of the decorative item. A multiplicity of such decorative items are known from the sacred sphere for the safekeeping of relics. However, the keeping of human body parts, such as bones or teeth, has nowadays become to some extent taboo in Western cultures and has a somewhat morbid flavor to it. It is therefore desirable to have alternatives.

Japanese patent application JP 2002085116 discloses decorative items in which human hairs are embedded by means of resins into an orifice provided for this purpose. In the production of such decorative items, although the relation to the desired person is achieved in material terms, nevertheless the artist's or goldsmith's creative freedom is greatly restricted, since he must necessarily provide a sufficiently large reception space for the resin/hair mixture. Moreover, the connection between the actual decorative item and the resin/hair mixture introduced can be released by simple means, and therefore the close relationship with the decorative item is absent.

Patent application US 2002/0025392 describes a method for the production of mementos from glass with cremated human or animal remains. The ash is intermixed with an additive which assists the production of glass and is processed into a powder. The memento is subsequently produced from glass. In production terms, the ash constitutes an undesirable impurity in the glass. This gives the consumer the feeling that the glass and therefore the memento are not refined, but are in some way contaminated by the ash, thus, again, making it difficult for these mementos to be accepted on the market.

Patent application WO 03/008084 describes a method for the production of artificial precious stones, in which carbon of human or animal origin is used. The carbon is generated as a result of the cremation of human or animal remains. The ash is filtered, purified by means of a halogen purification stage and subsequently graphitized. From the graphite thus obtained, the precious stones are subsequently produced by means of known sublimation techniques.

A further method for the production of personalized artificial precious stones or diamonds is disclosed in WO 2006/082259. Part of the carbon required is obtained by the carbonization of keratin of human or animal origin, for example a lock of hair. One disadvantage of these precious stones is their high price which is caused primarily by the extremely complicated production process. The production of artificial personalized precious stones is complicated, and it requires a large amount of initial material, complicated purification processes and complex production devices. Moreover, these precious stones cannot be used universally in decorative items for structural reasons.

A method for the production of carbon-enriched material by means of the carbonization of an initial material which at least partially contains human or animal hair is known from German laid-open publication DE 1255629.

The U.S. Pat. No. 6,382,111 B1 describes a further method for the production of mementos from incineration residues of cremation (for example, bones or ash of cremated body parts of human or animal origin). It becomes clearly apparent from the description and patent claim 1 that the incineration residues are calcined in an essential method step, that is to say the organic constituents and the carbon are largely removed. In one exemplary embodiment, it is proposed to add an ash calcined in this way to a metal melt. Since the ash and the metal do not mix, the ash floats on the metal as a result of its lower density and, during the subsequent cooling of the metal, settles on the surface of the final product. After cooling, the final product is further processed mechanically into a metal sheet, the sides provided with ash are laid together, and the ash is at least partially included in the metal material by means of pressing. In a further exemplary embodiment, U.S. Pat. No. 6,382,111B1 describes the production of a mixture of copper powder and a finely ground calcined bone ash with the addition of PVA. The mixture is cold-pressed and subsequently melted. After cooling, the copper together with the melted-in ash can be polished. Such personalized decorative items made from metal, in which the ash is bound mechanically into the metal, have a multiplicity of disadvantages: the durability or resistance of the material properties is restricted, since the ash is bound to the surface or inside the decorative item solely by means of mechanical forces. Individual shaping during processing in the cold state is restricted, and processing in the heated state or by means of molten metal is not possible, since the ash otherwise is separated from the metal again and floats up.

The object of the present invention, therefore, is to make available a method for the individualization of a metallic material, which method does not have the disadvantages listed above.

SUMMARY OF THE INVENTION

A further object of the present invention is to make available an individualized metallic material which is suitable for the production of symbolic articles due to improved material properties, this novel material being capable of being processed in a simple way and of being produced cost-effectively and in small quantities, and not subjecting the craft worker to any further restrictions in terms of creative freedom and design.

The objects on which the invention is based are achieved by means of the technical features of the method and of the ornamental alloy according to the independent claims 1 and 19. The features defining the idea of the invention are in each case the subject matter of the dependent claims 2 to 18 and 20 to 22.

An essential aspect of the present invention is that carbon of organic origin is bound chemically and physically into a metallic material which serves for the production of a symbolic article or of which a symbolic article at least partially consists. According to the invention, individualized ornamental alloys are produced from metallic materials for further processing into individualized decorative items or mementos, or previously manufactured decorative items or mementos are individualized. For the sake of simplicity, the present application speaks only of ornamental alloys, this term also embracing, unless mentioned otherwise, previously manufactured symbolic articles, such as pieces of jewelry, decorative items or mementos.

DETAILED DESCRIPTION

An initial material for the production of a personalized ornamental alloy originates in this case from a carbon-containing organic basic material from selected clearly identifiable individuals or clearly identifiable groups of individuals. In the production method according to the invention, such a basic material is converted into a carbon-enriched initial material. The basic material originates from clearly identifiable individuals or groups of individuals, preferably from clearly identifiable humans or such groups of humans. For the sake of simplicity, only a person is referred to below, although, unless expressly mentioned otherwise, this term also embraces a group of persons, for example a married couple, and animals, for example a domestic animal, or a group of animals. Using the clearly identifiable basic material clearly assigned to a person ensures that the metallic ornamental alloy to be produced or the symbolic articles to be produced possess an individual and direct material relation to the respective person.

The method for the individualization or personalization of the metallic material comprises two essential method steps: on the one hand, a conversion of the clearly identifiable basic material of organic origin clearly assigned to a person into a carbon-enriched, preferably carbonized initial material, and, on the other hand, the physical and chemical incorporation of the carbon-enriched or carbonized initial material, in particular of the carbon of the initial material, into a suitable metallic material. The initial material in this case serves essentially as a carbon donor.

The term "metallic material" in this context comprises at least the following: pure metals, metallic alloys, pseudoalloys, mixtures of metals or carbides, which at room temperature are at least partially in a crystalline form, that is to say form a solid body with a crystal or metal lattice structure or with various lattice structures. Preferably, those metallic materials are selected which are known to a person skilled in the art from jewelry production, in particular from goldsmithing.

For the production of an ornamental alloy according to the invention at least part of the initial material according to the present invention is intercalated physically and chemically in the metallic material, preferably is incorporated or dissolved interstitially into the crystalline structure of the metallic material. Incorporation in this case takes place either directly into the lattice structure of the metallic material, or of a part thereof, and/or into a boundary layer between various lattice structures, or parts thereof Incorporation involves at least part of the initial material, preferably the carbon, forming with the metallic material carbon-rich mixed crystals, intermediate phases or carbides or being dissolved directly in the metallic material. After incorporation, permanent physical and chemical interaction occurs between the initial material and the metallic material.

The successful enrichment or intercalation of the initial material or carbon can be checked by means of a weight measurement. In this case, the weight fraction of the initial material or carbon bound in the metallic material is determined by means of an accurate weight measurement of the metallic material, of the ornamental alloy or of the symbolic article before and after enrichment or incorporation. A further possibility for accurately determining the carbon enrichment which has taken place as a result of the method according to the invention is to use an optical emission spectrometry measurement (Inductively Coupled Plasma Optical Emission Spectrometry) which is customary and widespread in metallurgy and material testing.

The metallic material used is preferably metals, such as aluminum Al, silicon Si, titanium Ti, vanadium V, chrome Cr, manganese Mn, iron Fe, niobium Nb, molybdenum Mo, tantalum Ta, tungsten W, palladium Pd or platinum Pt. Metallic materials from this group are distinguished by two properties: on the one hand, they bind carbon in significant quantities, preferably in an extent of at least 0.5 percent by weight; on the other hand, they can be alloyed with other metals, such as gold Au, silver Ag or copper Cu. The latter are typically used for the production of jewelry, but cannot themselves incorporate carbon, or only in very small quantities, for example up to 2 per thousand weight fraction.

What has to be understood as being a symbolic article are, irrespective of their shape and configuration (design) and size, articles or components of articles which have special symbolic significance for a person, in particular man or woman, such as, for example, a piece of jewelry or a decorative item (ring, watch, music box), an article associated with memories (molten piece of metal, key fob, key, knife, picture frame, medal, goblet), a lucky charm (coin) or a talisman.

The incorporation of the initial material takes place either into the metallic material, from which one or more symbolic articles are subsequently produced completely or partially, or into metallic material of one or more symbolic articles already produced.

According to the present invention, the carbon-containing organic basic material which can be assigned clearly to a specific person is converted into a carbon-enriched, preferably carbonized initial material. If necessary, the carbon content of the basic material is increased during conversion into the initial material, that is to say simultaneously or subsequently in a further method step. The carbonization or carbon enrichment of the basic material preferably takes place by means of the coking, charring or graphitization of the basic material. According to a further embodiment of the invention, even remains from incineration or cremation can be purified and treated as basic material in such a way that the treated material can be used as initial material.

In general, the initial material comprises preferably between 45 and 100 percent by weight, preferably between 70 and 100 percent by weight and particularly preferably more than 75 to 95 percent by weight of carbon. According to a preferred embodiment, the initial material is in pulverized or fine-grained form with a grain size of less than 50 mesh.

What preferably serves as basic material for producing the initial material according to the invention is human, animal or, if need be, even vegetable material which can be assigned clearly to a specific person, for example a partner in marriage or a domestic animal, or to a group of persons, for example the members of a family or a married couple or several animals. According to preferred embodiments, the basic material used is keratin-containing human or animal material, such as, for example, hair, fur, fingernails or mixtures thereof.

The selection of the organic basic material which originates from at least one specific clearly identifiable person may be influenced by the following questions:

Who, that is to say which individual (man or woman) or which group of individuals, selects the basic material? (For example, a relative of a deceased person or a married couple)

From which person does the basic material originate? (For example, hair or carbonized incineration residues from a deceased person or hair of both partners in marriage)

It is critical that, according to the present invention, the initial material is assigned clearly to the basic material and, consequently, to a specific clearly identifiable person, so that, after the incorporation of the initial material into the metallic material by the method according to the invention, an ornamental alloy and/or a symbolic article is obtained which constitutes a material association with the specific clearly identifiable person.

Further selection possibilities regard the metallic material, from which the ornamental alloy or the symbolic article is to be produced completely or partially, and regard the symbolic article, the metallic material of which is to be individualized.

If, according to a further preferred embodiment, the metallic material comprises alloys of a first material group and of a second material group, the initial material is preferably incorporated predominantly into the first material group. The first material group is in this case distinguished with respect to the second material group in that it is preferably suitable for the enrichment of the initial material or of the carbon of the initial material or in that the initial material is bound preferably or predominantly only in the first material group.

The fraction of the initial material incorporated into the metallic material or into the first material group of the metallic material can be calculated stoichiometrically for materials forming carbides and it can be from 0.5 or less percent by weight to 45 or more percent by weight, for example 42.8 percent by weight for SiC. In the case of metallic material or the first material group of a metallic material which form no stoichiometrically calculable carbides with the initial material, but are based on interstitial incorporation or interstitial dissolution of the carbon, the fraction of the incorporated initial material is likewise up to several percent by weight, preferably between 1 and 10 percent by weight, particularly preferably between 1.2 and 5 percent by weight.

According to the present invention, the basic material and consequently the carbon-enriched initial material and, in particular, its carbon fraction, which is preferably used for producing the individualized ornamental alloy or the individualized symbolic articles, preferably originates from a carbonization or coking of human or animal keratin.

The method for the individualization or personalization of metallic material is also possible with another initial material which can be incorporated in a similar way into the metallic material, for example a nitrogen-enriched initial material. Like carbon, nitrogen can be intercalated or dissolved interstitially into the lattice structure of a metallic material.

As already stated, the incorporation of the initial material or of the carbon into the metallic material takes place by means of a physical and chemical active mechanism or physical and chemical interaction between the initial material and the metallic material. This may be achieved via diffusion or carburization, by crystallizing out or by dissolution. Pulverant or fine-grained initial material with a grain size of less than 50 mesh facilitates both the diffusion of the initial material into the metallic material and the full mixing of the initial material and of the metallic material before crystallizing out or dissolution.

In carburization, as it is known, the carbonized initial material is brought into interaction with the metallic material. The duration and conditions of interaction depend on the material properties of the metallic material and, at temperatures below the melting point, amount to a few hours to a few days. In this case, the carbon of the initial material diffuses into the metallic material and forms mixed crystals, intermediate phases or carbides. Diffusion preferably takes place at least partially with the exclusion of air, that is to say under conditions with a minimum oxygen content, in order to prevent or minimize the oxidation of the initial material and/or of the metallic material. In the case of low-carbon irons or steels, a carbon content of 1 to 1.2 percent by weight can in this case be achieved in the first millimeter of the surface within 8 hours at 950° C.

Carburization is also highly suitable for the individualization of already finished, that is to say ready-produced metallic or metal-containing pieces of jewelry or symbolic articles, because it can be carried out below the melting point of the metallic material.

In crystallizing out, the initial material is mixed with the metallic material in a first temperature range T1 above the melting temperature of the metallic material, for example 300° C. to 400° C. above the melting point. This first mixture is subsequently cooled to a second temperature range T2. The second temperature range T2 lies, for example, 100° C. to 150° C. above the temperature at which the entire melt of the metallic material crystallizes out, that is to say changes (solidifies) completely into a metallic solid body of crystalline structure. In the second temperature range T2, however, part of the initial material, already crystallizes out with part of the melted metallic material and forms a carbon-rich second mixture consisting of mixed crystals, intermediate phases or carbides. The longer and the more accurately the second temperature range T2 is maintained or preserved, the more initial material can be bound in the metallic material. During further cooling to below the second temperature range T2, the melted metallic material still present and having the second mixture then crystallizes out completely. Non-bound initial material, because of its lower density, is left behind on the surface of the crystallized-out material, for example as slag, and can be removed in a simple way.

Crystallizing out is suitable for metallic material which, during crystallization, binds carbon into its lattice structure or into boundary regions of two lattice structures. Crystallizing out is also a preferred method for the production of metallic materials or ornamental alloys which comprise a first and a second material group in which the initial material is bound preferably or predominantly only into one of the two material groups and in which the two material groups crystallize out together, that is to say fully mixed and therefore alloyed. The first material group comprises, in particular, carbide-forming metals, such as silicon, titanium, vanadium, chrome, iron, niobium, molybdenum, tantalum and tungsten, or mixtures (alloys) thereof, which can be alloyed with metals of the second material group, such as gold, silver and copper, or mixtures thereof.

A person skilled in the art can select the temperature holding points, that is to say the first and second temperature ranges T1 and T2, of all the preferred metallic materials on the basis of measured or calculated phase diagrams.

In dissolution, carbon of the initial material is directly bound or dissolved interstitially in the melted metallic material at the atomic level and is subsequently cooled rapidly. During crystallization while the cooling of the melt is taking place, in particular, the carbon of the initial material is left with no time to be aggregated again, and the carbon remains distributed and bound at atomic level in interspaces of the regular crystal lattice of the metallic material. Dissolution is suitable for metallic material which forms no or only inadequately mixed crystals, intermediate phases or carbides with the initial material or carbon. Representatives of metallic material of this group are manganese, palladium and platinum. Platinum is capable in this way of permanently absorbing 1.2 percent by weight of carbon into its crystal lattice.

Both in crystallizing out and in dissolution, the incorporation of the initial material takes place in the completely or partially melted state of the metallic material. Accordingly, these methods are suitable for the production of ornamental alloys, for example wires or blanks for decorative purposes, and also for the molding of ornamental alloys or finished symbolic articles.

According to preferred exemplary embodiments, melting and molding take place in an induction furnace with a vacuum chamber, that is to say largely with the exclusion of air, to prevent or minimize oxidation processes. The convection movements and flows in the melt which are associated with heating by induction assist the full mechanical mixing of the initial material and metallic material and prevent segregation on account of the differing density of the materials. So that predominantly carbon of the initial material is bound into the metallic material, crucibles or casting molds must be used which preferably contain no foreign carbon, that is to say, for example, no graphite-containing crucibles or molds.

The invention is explained below by means of exemplary embodiments, without the idea of the invention being restricted to the embodiments described.

According to a first exemplary embodiment, an already previously manufactured memento consisting of iron is personalized or individualized by means of carburization. The memento is closed off, air-tight, in a container together with an initial material in the form of pulverant carbon. The initial material originates from a coking of hair of a specific clearly identifiable person. The container is subsequently heated for several hours to a few days, for example 8 to 10 hours, to a temperature of between 600° C. and the melting point of iron, usually to 950° C. In this case, the carbon of the initial material diffuses into the iron up to a few millimeters, usually 0.8 to 1.2 mm. By means of this method, the iron can be enriched with up to a stoichiometrically maximum possible 6.67 percent by weight of carbon.

In a second exemplary embodiment, a pair of individualized gold/titanium wedding rings is produced by crystallizing out, initial material from both partners in marriage being used. Gold and titanium are completely miscible and form stable mixed crystals in any weight ratio. The production of a pair of gold/titanium rings with 18 carat gold takes place from an initial pulverant mixture consisting of the following percentages by weight: 75% gold, 22% titanium and initial material, the carbon quantity of which corresponds at least to the remaining 3%. The mixture is melted in an induction furnace at 2000° C. (in the first temperature range T1) and is intermixed and homogenized for 2 hours by induction convection. The melt is subsequently cooled to 1800° C. (in the second temperature range T2) and is held at this temperature for two further hours in order to allow carbide crystallization. In the subsequent molding of the two rings, a homogenous and fine-crystalline 18 carat gold/titanium alloy with a 2 to 3 percent by weight carbon fraction is obtained.

In a third exemplary embodiment, an individualized watch case consisting of platinum is produced by dissolution. Pulverant carbon-rich initial material is dissolved in platinum in an induction furnace above the eutectic temperature of the platinum/carbon mixture of approximately 1730° C. During subsequent rapid cooling of the melt below the eutectic temperature as a result of molding, approximately 1.2 percent by weight of carbon remains bound in the interspaces of the platinum crystal lattice. The platinum with the bound carbon is then further processed in a normal way. As a result of alloying with gold or silver, the eutectic temperature of the platinum/carbon mixture can be lowered, or it can be increased by alloying with tungsten.

The invention claimed is:

1. A method for the individualization of a metallic material by means of a carbon-containing basic material of organic origin, comprising the following steps:

a. conversion of a carbon-containing organic basic material, which originates from at least one specific identifiable person or at least one identifiable specific group of persons, into a carbon-enriched initial material, and b. physical and chemical incorporation of at least a fraction of the carbon-enriched initial material into the metallic material to provide an individualized metallic material wherein the carbon-enriched initial material is intermixed in a first temperature range T1 with melted metallic material and, during subsequent cooling to a second temperature range T2 at least part of the carbon-enriched initial material is bound into part of the melted metallic material and crystallizes out as a second mixture in the remaining melted metallic material, wherein the metallic material is an alloy of a first material and a second material, the first material being selected from the group consisting of: silicon, titanium, vanadium, chrome, iron, niobium, molybdenum, tantalum, tungsten and alloys thereof, and the second material being selected from the group consisting of: gold, silver, copper, and alloys thereof, and wherein the carbon-enriched initial material is incorporated predominantly into the first material.

2. The method of claim 1, wherein incorporation takes place at least into part of the crystalline structure and/or at least partially between various crystalline structures of the metallic material.

3. The method as claimed in claim 1, wherein at least part of the initial material forms mixed crystals, intermediate phases or carbides with the metallic material.

4. The method of claim 1, wherein the basic material comprises keratin of human or animal origin.

5. The method of claim 1, wherein the basic material is obtained from at least one specific identifiable person or at least one identifiable specific group of persons and can clearly be assigned to the person or group of persons.

6. The method of claim 1, wherein the carbon-enriched initial material is obtained by a charring, coking or graphitization of the basic material.

7. The method of claim 1, wherein the initial material contains between 45 and 100 percent by weight of carbon.

8. The method of claim 1, wherein the initial material is pulverant or fine-grained.

9. The method of claim 1, wherein the individualized metallic material contains at least 0.5 percent by weight of carbon from the initial material.

10. The method of claim 1, wherein at least part of the initial material is introduced into the metallic material by means of diffusion.

11. The method of claim 10, wherein diffusion takes place with the exclusion of air at a temperature below the melting point of the metallic material.

12. The method of claim 10, wherein the metallic material takes the form of a previously produced article.

13. The method of claim 1, wherein, during further cooling to below the second temperature range T2, the remaining melted metallic material and the second mixture solidify into an alloy.

14. The method of claim 1, wherein, before cooling to below the second temperature range T2, the melt is further processed into an article in a shaping method.

15. The method of claim 1, wherein melting or molding takes place with the exclusion of air in an induction furnace with a vacuum chamber.

16. A method for the individualization of a metallic material by means of a carbon-containing basic material of organic origin, comprising the following steps:

a. conversion of a carbon-containing organic basic material, which originates from at least one specific identifiable person or at least one identifiable specific group of persons, into a carbon-enriched initial material, and b. physical and chemical incorporation of at least a fraction of the carbon-enriched initial material into the metallic material to provide an individualized metallic material, wherein the carbon-enriched initial material is dissolved or dispersed in melted metallic material and, during the crystallization of the melted metallic material while the initial material is rapidly cooled, is incorporated into the metallic material, wherein the metallic material is an alloy of a first material and a second material, the first material being selected from the group consisting of: silicon, titanium, vanadium, chrome, iron, niobium, molybdenum, tantalum, tungsten and alloys thereof, and the second material being selected from the group consisting of: gold, silver, copper and alloys thereof, and wherein the carbon-enriched initial material is incorporated predominantly into the first material.

17. The method of claim 16, wherein incorporation takes place at least into part of the crystalline structure and/or at least partially between various crystalline structures of the metallic material.

18. The method as claimed in claim 16, wherein at least part of the initial material forms mixed crystals, intermediate phases or carbides with the metallic material.

19. The method of claim 16, wherein the basic material comprises keratin of human or animal origin.

20. The method of claim 16, wherein the carbon-enriched initial material is obtained by a charring, coking or graphitization of the basic material.

* * * * *